US007285878B2

(12) United States Patent
McGill et al.

(10) Patent No.: US 7,285,878 B2
(45) Date of Patent: Oct. 23, 2007

(54) LINEAR MOTOR CONTROLLER

(75) Inventors: Ian McGill, Auckland (NZ); Zhuang Tain, Auckland (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 373 days.

(21) Appl. No.: 11/095,270

(22) Filed: Mar. 31, 2005

(65) Prior Publication Data

US 2005/0168179 A1 Aug. 4, 2005

Related U.S. Application Data

(62) Division of application No. 10/898,808, filed on Jul. 26, 2004, now Pat. No. 6,954,040, which is a division of application No. 10/293,874, filed on Nov. 13, 2002, now Pat. No. 6,812,597.

(30) Foreign Application Priority Data

Nov. 20, 2001 (NZ) ..... 515578

(51) Int. Cl.
*H20K 41/00* (2006.01)

(52) U.S. Cl. ..... 310/12; 310/13; 310/15; 318/135

(58) Field of Classification Search ..... 310/12, 310/13, 15; 318/135; 417/44.1
See application file for complete search history.

(56) References Cited

U.S. PATENT DOCUMENTS

| | | | | |
|---|---|---|---|---|
| 3,886,419 | A | 5/1975 | Omura et al. | |
| 4,036,018 | A | 7/1977 | Beale | |
| 4,179,899 | A | 12/1979 | Katayama | |
| 4,283,920 | A | 8/1981 | Kainuma et al. | |
| 4,291,258 | A | 9/1981 | Clark et al. | |
| 4,320,448 | A | 3/1982 | Okuda et al. | |
| 4,346,318 | A | 8/1982 | Shtrikman | |
| 4,349,757 | A | 9/1982 | Bhate | |
| 4,602,174 | A | 7/1986 | Redlich | |
| 4,836,757 | A | 6/1989 | Curwen et al. | |
| 4,838,771 | A | 6/1989 | Kikuchi | |
| 4,854,833 | A | 8/1989 | Kikuchi et al. | |
| 4,857,814 | A | 8/1989 | Duncan | |
| 5,055,011 | A | 10/1991 | Mori | |
| 5,342,176 | A | 8/1994 | Redlich | |
| 5,592,257 | A | 1/1997 | Sakamoto et al. | |
| 5,613,259 | A | 3/1997 | Craft et al. | |
| 5,945,748 | A | 8/1999 | Park et al. | |
| 5,955,799 | A * | 9/1999 | Amaya et al. | 310/36 |
| 5,980,211 | A | 11/1999 | Tojo et al. | |
| 6,074,172 | A | 6/2000 | Huang | |
| 6,077,054 | A | 6/2000 | Lee et al. | |

(Continued)

FOREIGN PATENT DOCUMENTS

| | | |
|---|---|---|
| EP | 246468 | 11/1987 |

(Continued)

*Primary Examiner*—Darren Schuberg
*Assistant Examiner*—Iraj A. Mohandesi
(74) *Attorney, Agent, or Firm*—Trexler, Bushnell, Giangiorgi, Blackstone & Marr, Ltd.

(57) ABSTRACT

A sensorless method of detecting piston collisions in a reciprocating free piston linear compressor driven by an electronically commutated linear motor having at least one excitation winding is provided. A free piston gas compressor is also provided.

2 Claims, 6 Drawing Sheets

U.S. PATENT DOCUMENTS

| | | | | |
|---|---|---|---|---|
| 6,437,524 | B1 * | 8/2002 | Dimanstein | 318/135 |
| 6,501,240 | B2 * | 12/2002 | Ueda et al. | 318/135 |
| 6,506,030 | B1 | 1/2003 | Kottke | |
| 6,536,326 | B2 | 3/2003 | Unger et al. | |
| 6,657,326 | B1 | 12/2003 | Yamamoto et al. | |
| 6,685,438 | B2 | 2/2004 | Yoo et al. | |

FOREIGN PATENT DOCUMENTS

| | | | |
|---|---|---|---|
| EP | 726394 | | 8/1996 |
| JP | 9250449 | | 9/1997 |
| SU | 792511 | | 12/1980 |
| WO | WO98/35428 | | 8/1998 |
| WO | WO 00/15482 | * | 3/2000 |
| WO | WO 00/16482 | | 3/2000 |
| WO | WO 00/79671 | | 12/2000 |
| WO | WO 01/48379 | | 7/2001 |
| WO | WO 01/48379 | A1 * | 7/2001 |
| WO | WO 01/79671 | | 10/2001 |

* cited by examiner

LINEAR MOTOR CONTROLLER

This application is a divisional application of U.S. patent application Ser. No. 10/898,808, filed on Jul. 26, 2004 now U.S. Pat. No. 6,954,040, which is a divisional application of U.S. patent application Ser. No. 10/293,874, filed on Nov. 13, 2002, which issued as U.S. Pat. No. 6,812,597 on Nov. 2, 2004.

FIELD OF INVENTION

This invention relates to a controller for a linear motor used for driving a compressor and in particular but not solely a refrigerator compressor.

SUMMARY OF THE PRIOR ART

Linear compressor motors operate on a moving coil or moving magnet basis and when connected to a piston, as in a compressor, require close control on stroke amplitude since unlike more conventional compressors employing a crank shaft stroke amplitude is not fixed. The application of excess motor power for the conditions of the fluid being compressed may result in the piston colliding with the cylinder head in which it is located.

In International Patent Publication no. WO01/79671 the applicant has disclosed a control system for free piston compressor which limits motor power as a function of property of the refrigerant entering the compressor. However in some free piston refrigeration systems it may be useful to detect an actual piston collision and then to reduce motor power in response. Such a strategy could be used purely to prevent compressor damage, when excess motor power occurred for any reason or, could be used as a way of ensuring high volumetric efficiency. Specifically in relation to the latter, a compressor could be driven with power set to just less than to cause piston collisions, to ensure the piston operated with minimum head clearance volume. Minimising head clearance volume leads to increased volumetric efficiency.

SUMMARY OF THE INVENTION

It is an object of the present invention to provide a linear motor controller which goes some way to achieving the above mentioned desiderata.

It is a further object to provide a sensorless system for detecting piston collisions in a free piston compressor.

Accordingly in one aspect the invention consists in a free piston gas compressor comprising:

a sensorless method of detecting piston collisions in a reciprocating free piston linear compressor driven by an electronically commutated linear motor having at least one excitation winding comprising providing an indication of a piston collision upon detection of any sudden change in the characteristics of the back EMF waveform induced in said at least one excitation winding.

In a second aspect the invention consists in a sensorless method of detecting piston collisions in a reciprocating free piston linear compressor driven by an electronically commutated linear motor having at least one excitation winding comprising the steps of:

obtaining the time varying back EMF induced in said at least one excitation winding, monitoring said back EMF at least in the regions near the back EMF zero-crossings, extracting parameters characterising said back EMF waveform;

analysing said parameters; and providing an indication of a piston collision upon detection of any sudden change in said parameters.

In a third aspect the invention consists in a free piston gas compressor comprising:

a cylinder, a piston reciprocable in said cylinder, a recriprocating electronically commutated linear electric motor drivably coupled to said piston having at least one excitation winding, a current controller which controls the input power to said at least one excitation winding, a back EMF detector which monitors at least a portion of the time varying back EMF induced in said at least one excitation winding, a collision detection analyser which receives back EMF information from said back EMF detector and whenever it detects a sudden change in the characteristics of the back EMF causes said current controller to reduce input power to said at least one excitation winding.

Preferably said compressor further includes means for incrementally increasing the power input to said motor over a period of time in response to a reduction in power input.

In a fourth aspect the invention consists in a method of detecting piston collisions in a reciprocating free piston linear compressor driven by a linear motor having at least one excitation winding electronically commutated under the control of a programmed microprocessor wherein piston collisions are determined by the microprocessor software solely from microprocessor input signals from said at least one excitation winding and without input from any external transducer.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples.

BRIEF DESCRIPTION OF THE DRAWINGS

One preferred form of the invention will now be described with reference to the accompanying drawings in which.

DESCRIPTION OF THE PREFERRED EMBODIMENTS

Figure 1:
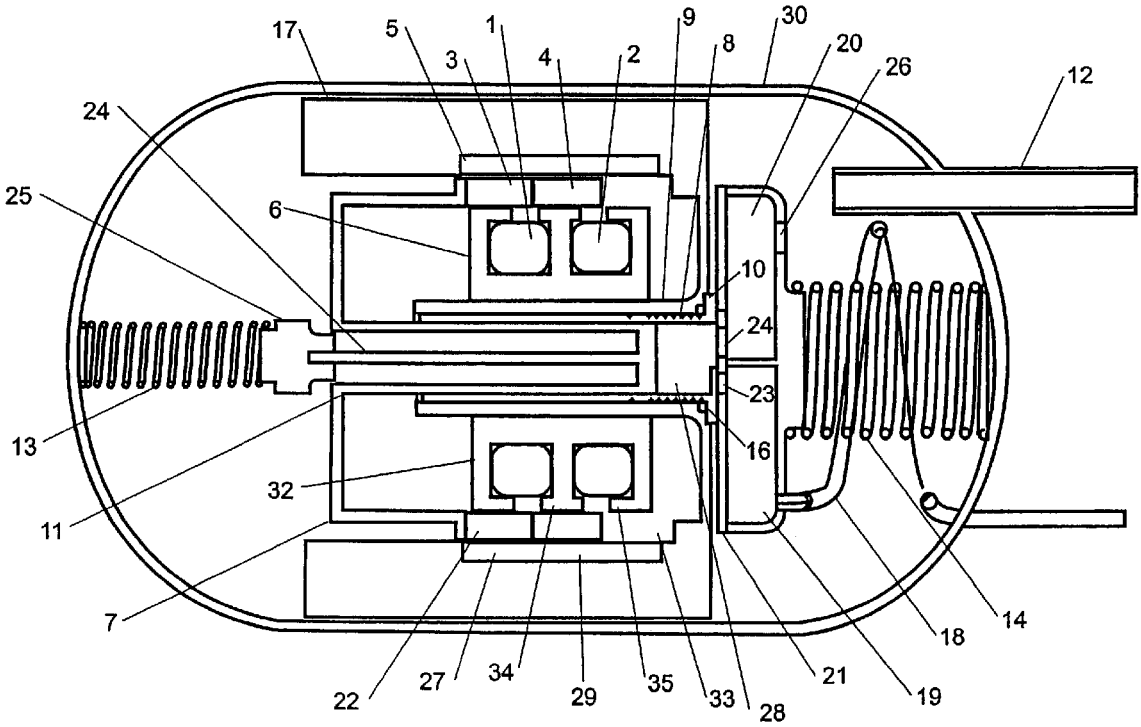
FIG. 1 is a cross-section of a linear compressor according to the present invention.

The present invention provides a method for controlling a free piston reciprocating compressor powered by a linear motor of the type shown in FIG. 1. Firstly it has a reduced size compared to the conventional linear motor of the type described in U.S. Pat. No. 4,602,174 and thus reduces the cost. This change keeps the efficiency high at low to medium power output at the expense of slightly reduced efficiency at high power output. This is an acceptable compromise for a compressor in a household refrigerator which runs at low to medium power output most of the time and at high power output less than 20% of the time (this occurs during periods of frequent loading and unloading of the refrigerator contents or on very hot days). Secondly it uses a control strategy which allows optimally efficient operation, while negating the need for external sensors, which also reduces size and cost.

While in the following description the present invention is described in relation to a cylindrical linear motor it will be appreciated that this method is equally applicable to linear motors in general and in particular also to flat linear motors, see for example our co-pending International Patent Application no. PCT/NZ00/00201 the contents of which are incorporated herein by reference. One skilled in the art would require no special effort to apply the control strategy herein described to any form of linear motor. The compressor shown in FIG. 1, involves a permanent magnet linear motor connected to a reciprocating free piston compressor. The cylinder 9 is supported by a cylinder spring 14 within the compressor shell 30. The piston 11 is supported radially by the bearing formed by the cylinder bore plus its spring 13 via the spring mount 25. The bearings may be lubricated by any one of a number of methods as are known in the art, for example the gas bearing described in our co-pending International Patent Application no. PCT/NZ00/00202, or the oil bearing described in International Patent Publication no. WO00/26536, the contents of both of which are incorporated herein by reference. Equally the present invention is applicable to alternative reciprocation systems. For example while below a compressor is described with a combined gas/mechanical spring system, an entirely mechanical or entirely gas spring system can be used with the present invention.

The reciprocating movement of piston 11 within cylinder 9 draws gas in through a suction tube 12 through a suction port 26 through a suction muffler 20 and through a suction value port 24 in a value plate 21 into a compression space 28. The compressed gas then leaves through a discharge value port 23, is silenced in a discharge muffler 19, and exits through a discharge tube 18.

The compressor motor comprises a two part stator 5,6 and an armature 22. The force which generates the reciprocating movement of the piston 11 comes from the interaction of two annular radially magnetised permanent magnets 3,4 in the armature 22 (attached to the piston 11 by a flange 7), and the magnetic field in an air gap 33 (induced by the stator 6 and coils 1,2).

Figure 2:
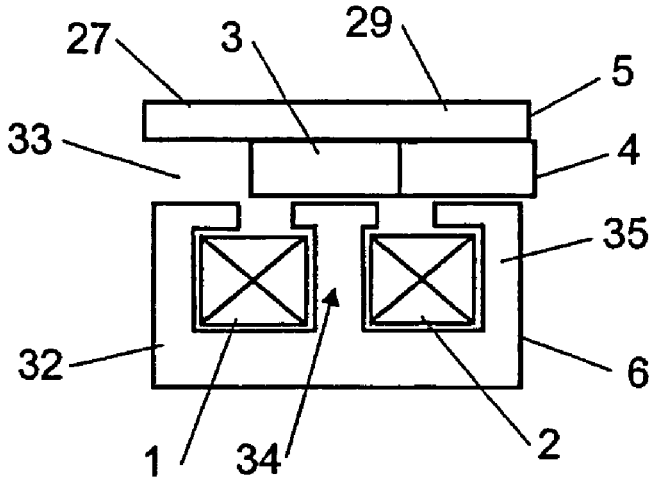
FIG. 2 is a cross-section of the double coil linear motor of the present invention in isolation.

The two coil version of the compressor motor shown in FIG. 1 and in isolation in FIG. 2, has a current flowing in coil 1, which creates a flux that flows axially along the inside of the stator 6, radially outward through the end stator tooth 32, across the air gap 33, then enters the back iron 5. Then it flows axially for a short distance 27 before flowing radially inwards across the air gap 33 and back into the centre tooth 34 of the stator 6. The second coil 2 creates a flux which flows radially in through the centre tooth 34 across the air gap axially for a short distance 29, and outwards through the air gap 33 into the end tooth 35. The flux crossing the air gap 33 from tooth 32 induces an axial force on the radially magnetised magnets 3,4 provided that the magnetisation of the magnet 3 is of the opposite polarity to the other magnet 4. It will be appreciated that instead of the back iron 5 it would be equally possible to have another set of coils on the opposite sides of the magnets.

An oscillating current in coils 1 and 2, not necessarily sinusoidal, creates an oscillating force on the magnets 3,4 that will give the magnets and stator substantial relative movement provided the oscillation frequency is close to the natural frequency of the mechanical system. This natural frequency is determined by the stiffness of the springs 13, 14 and mass of the cylinder 9 and stator 6. The oscillating force on the magnets 3,4 creates a reaction force on the stator parts. Thus the stator 6 must be rigidly attached to the cylinder 9 by adhesive, shrink fit or clamp etc. The back iron is clamped or bonded to the stator mount 17. The stator mount 17 is rigidly connected to the cylinder 9.

Figure 3:
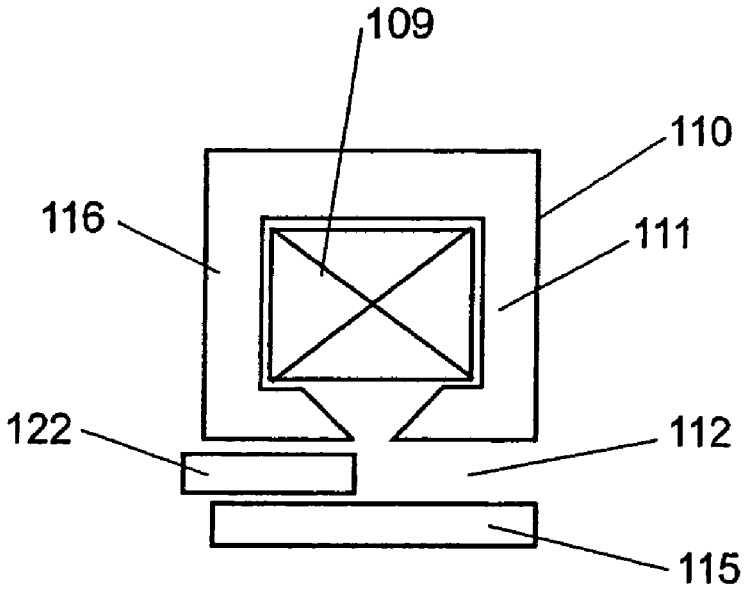
FIG. 3 is a cross-section of a single coil linear motor.

In the single coil version of the compressor motor, shown in FIG. 3, current in coil 109, creates a flux that flows axially along the inside of the inside stator 110, radially outward through one tooth 111, across the magnet gap 112, then enters the back iron 115. Then it flows axially for a short distance before flowing radially inwards across the magnet gap 112 and back into the outer tooth 116. In this motor the entire magnet 122 has the same polarity in its radial magnetisation.

Control Strategy

Experiments have established that a free piston compressor is most efficient when driven at the natural frequency of the compressor piston-spring system of the compressor. However as well as any deliberately provided metal spring, there is an inherent gas spring, the effective spring constant of which, in the case of a refrigeration compressor, varies as either evaporator or condenser pressure varies. The electronically commutated permanent magnet motor already described, is controlled using techniques including those derived from the applicant's experience in electronically commutated permanent magnet motors as disclosed in International Patent Publication no. WO01/79671 for example, the contents of which are incorporated herein by reference.

Figure 7:
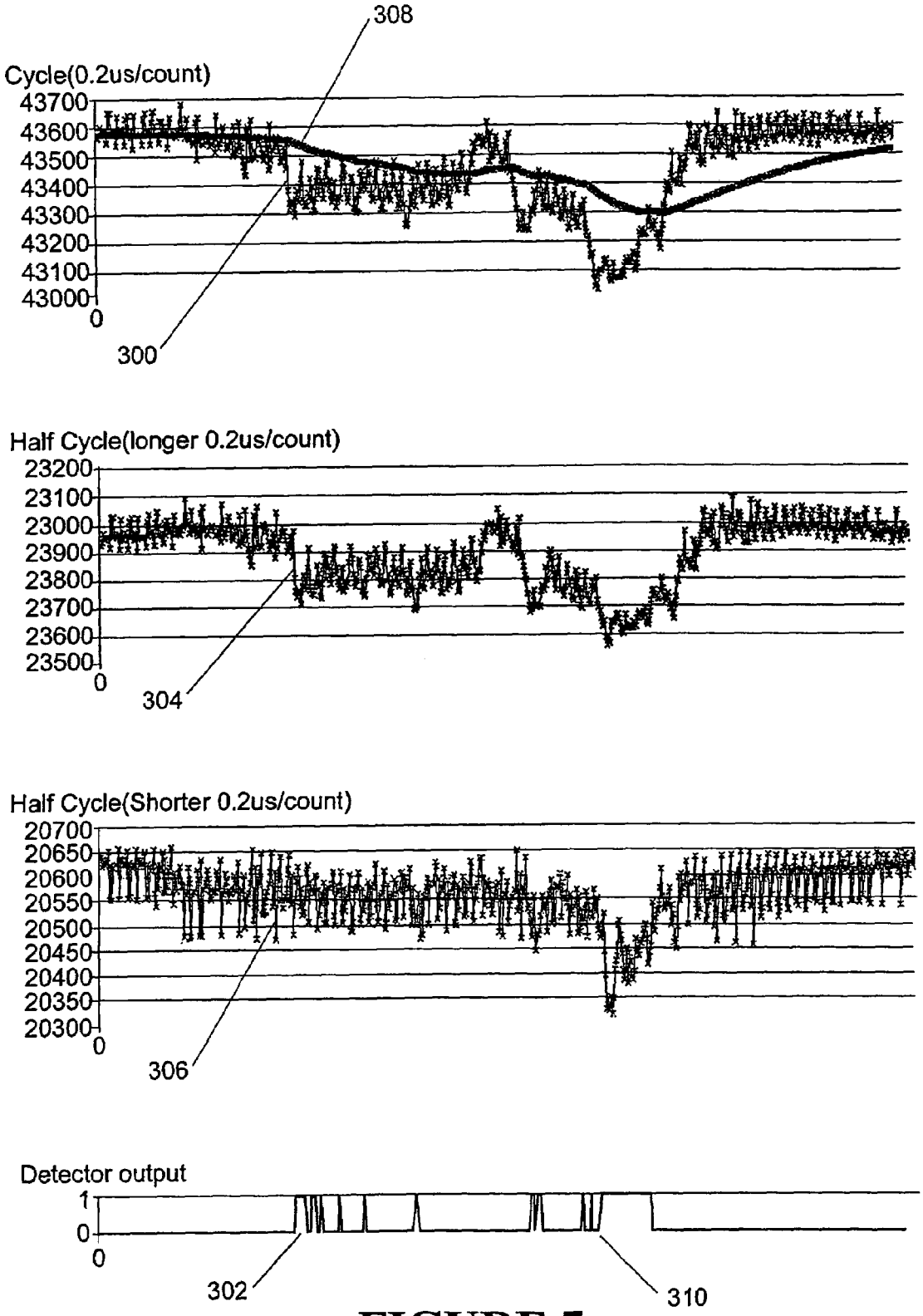
FIG. 7 shows a graph of piston reciprocation period versus time.

When the linear motor is controlled as described in WO01/79671 it is possible that the compressor input power increases to a level where the excursion of the piston (11, FIG. 1) results in a collision with the head of cylinder (9, FIG. 1). When this occurs (the first collision 302, see FIG. 7) the piston reciprocation period 300 is reduced compared to a filtered or smoothed value 308. More importantly because the piston period is made up of two half periods 304, 306, between bottom dead centre and top dead centre, the half periods are not symmetrical. The half period moving away from the head 304 is shorter than the half period moving towards the head 306, although both half periods are reduced in time whenever a piston collision occurs (second collision 310). In the preferred embodiment of the present invention a collision detector is provided by monitoring the half period times and when any reduction in the half period times is detected thereby indicating a collision the input power is reduced in response.

It will also be appreciated the present invention is equally applicable to a range of applications. It is desirable in any reciprocating linear motor to limit or control the maximum magnitude of reciprocation. For the present invention to be applied the system requires a restoring force eg: a spring system or gravity, causing reciprocation, and some change in the mechanical or electrical system which causes a change in the electrical reciprocation period when a certain magnitude of reciprocation is reached.

Figure 4:
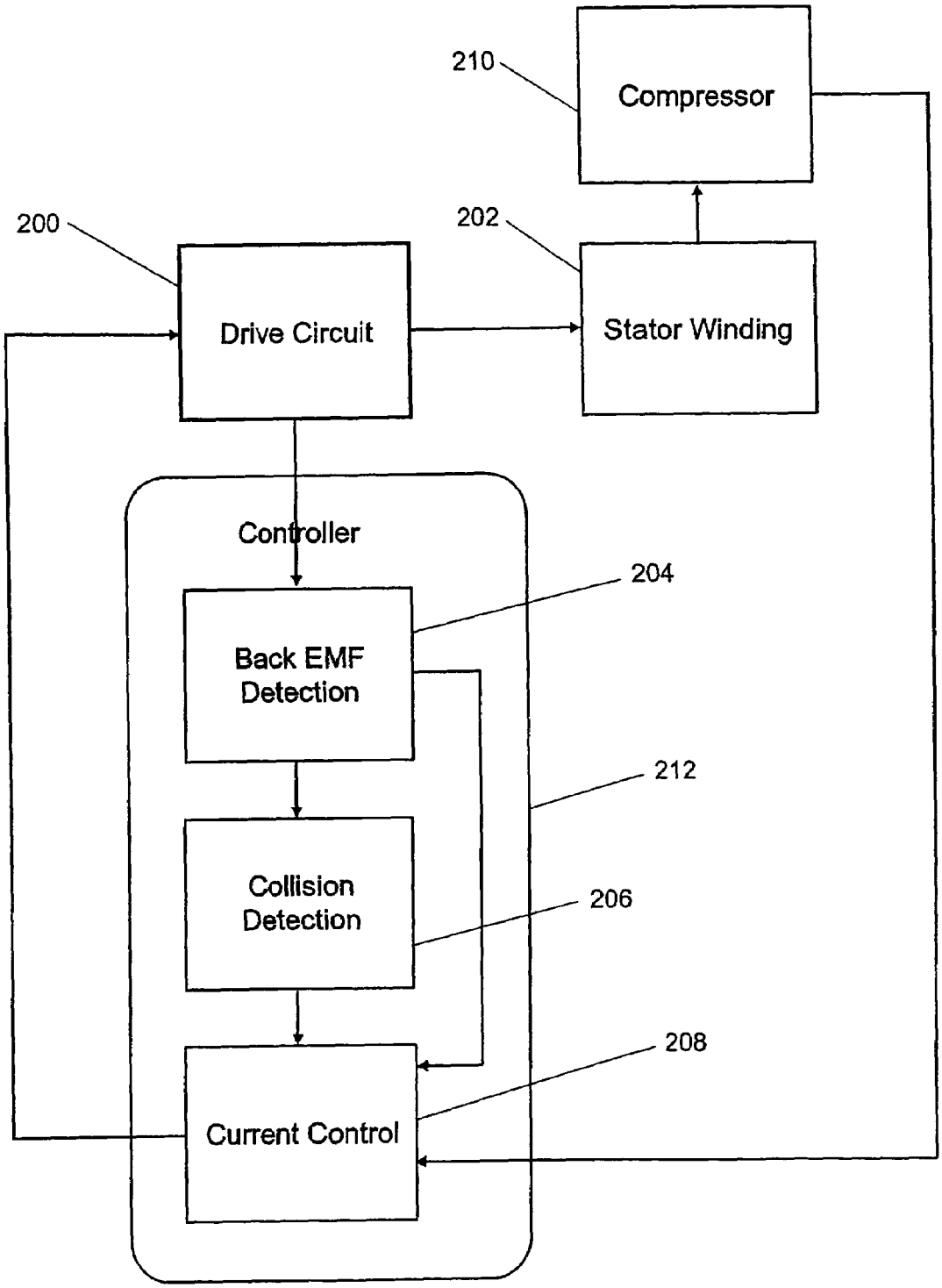
FIG. 4 is a block diagram of the free piston vapour compressor and associated controller of the present invention.

In the preferred piston control system shown in FIG. 4, back EMF detection is used to detect the electrical period of reciprocation. As already described the current controller 208 receives inputs from the compressor 210, the back EMF detector 204 and the collision detector 206. While in the preferred embodiment of the present invention the current controller 208, a back EMF detector 204 and a collision detector 206 functioning as described above. While in the preferred embodiment of the present invention the current controller 208, the back EMF detector 204 and the collision detection 206 are implemented in software stored in the microprocessor 212, they could equally be implemented in a single module or in discrete analogue circuitry. The collision detector 206 receives the electrical period data from the back EMF detector 204 allowing it to detect overshoot, or more specifically collision of the piston with the cylinder. The current controller 208 adjusts the maximum current through the duty cycle applied by the drive circuit 200 to the stator winding 202.

Figure 6:
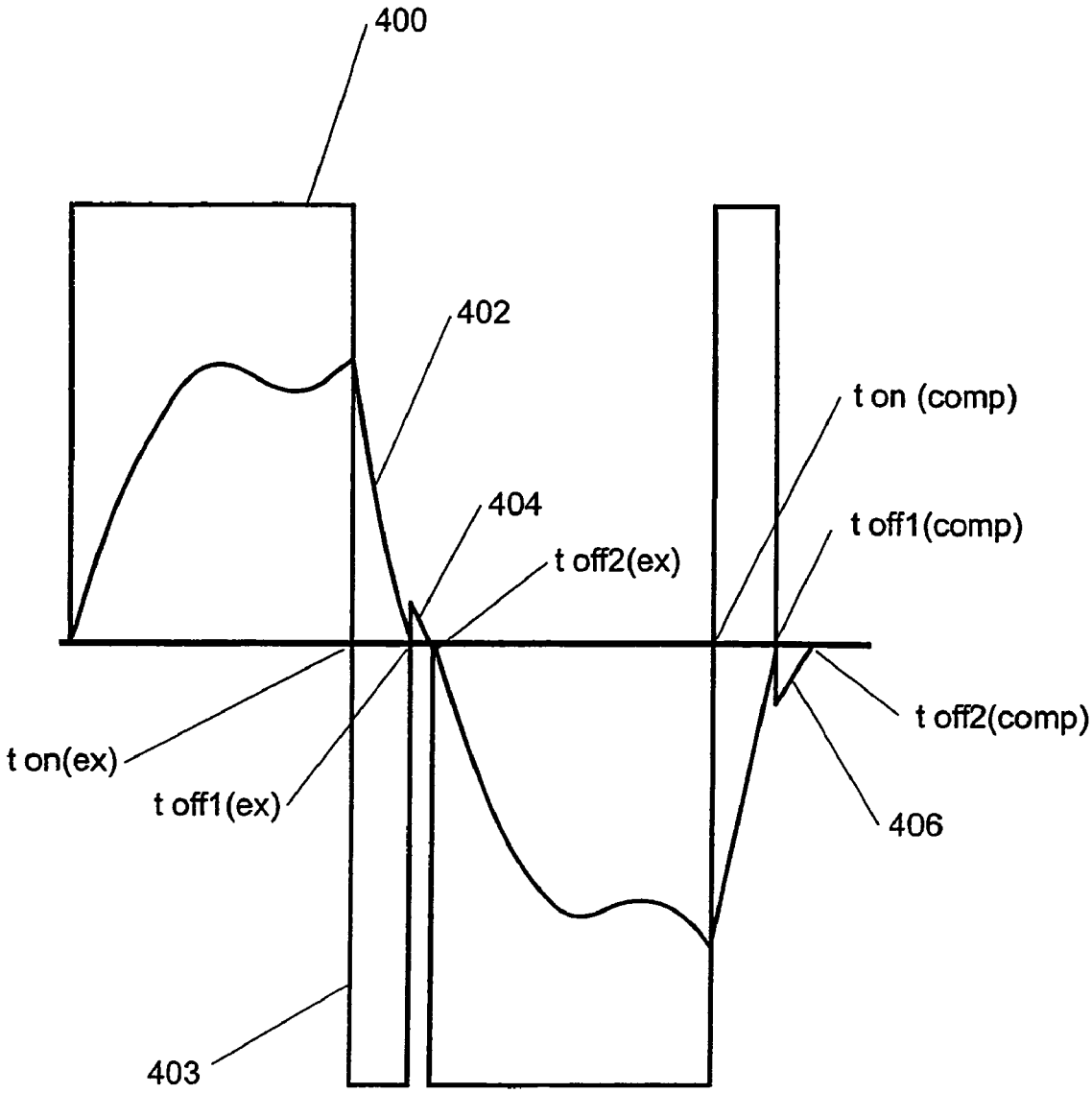
FIG. 6 shows a graph of compressor motor back EMF versus time.

Example waveforms in a linear motor employing the present invention are seen in FIG. 6 which shows waveforms of motor winding voltage (the first portion of which is referenced 400) and motor current (the first portion of which is referenced 402). The stator winding voltage at 400 is fully positive for a time $t_{on(ex)}$ during the beginning of the expansion stroke. With the voltage removed the current 402 decays (402) to zero over time $t_{off1(ex)}$, with the stator winding voltage forced fully negative (403) by the current flowing in the windings. For the remainder of the expansion stroke, time $t_{off2(ex)}$ the winding voltage represents the back EMF induced in the armature 404, and the zero crossing thereof represents zero velocity of the piston at the end of the expansion stroke. A similar pattern occurs during the compression stroke, rendering a time $t_{off2(comp)}$ relating to the zero crossing of the back EMF 406 during compression, from which the reciprocation time can be calculated.

Figure 5:
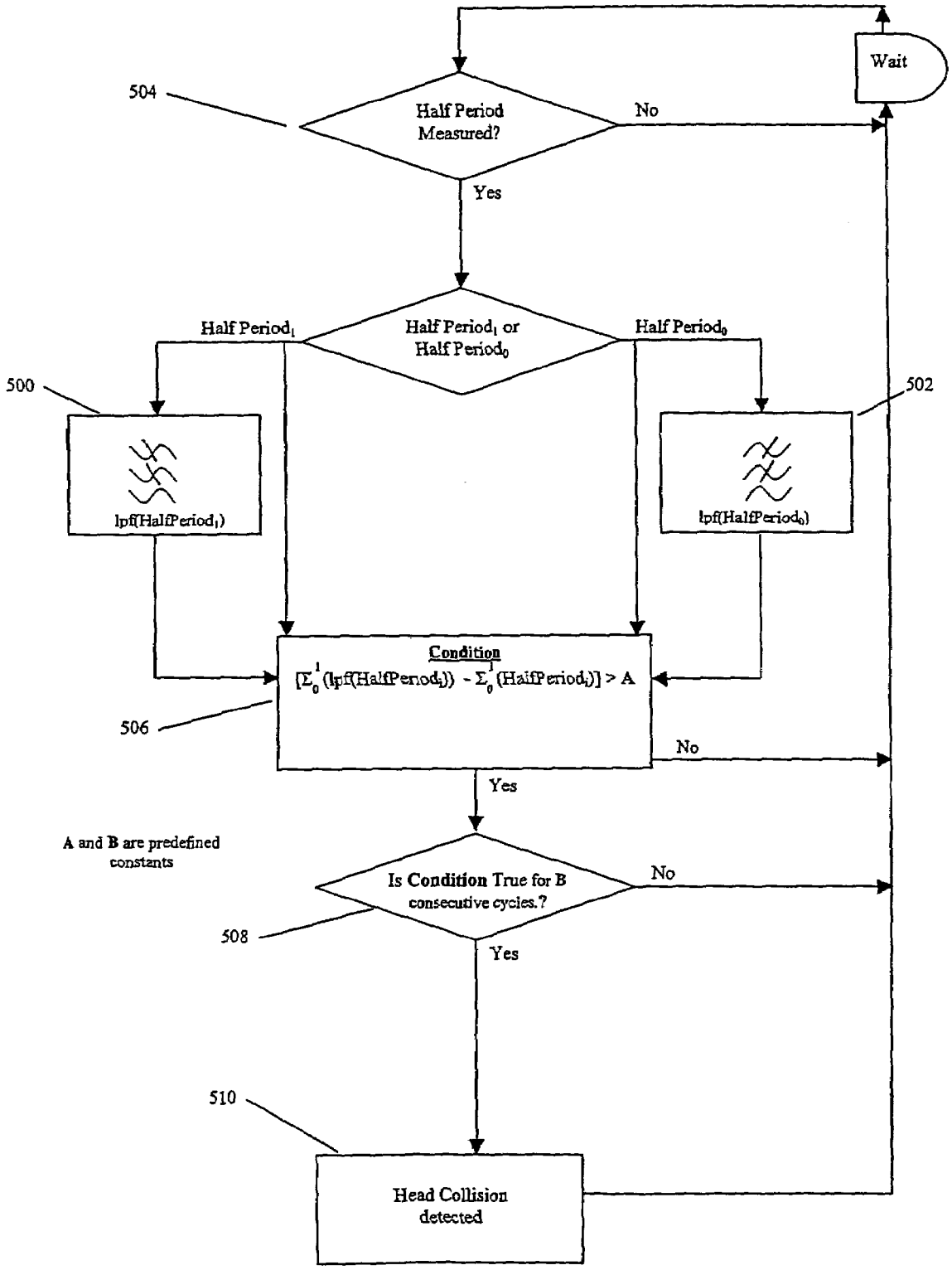
FIG. 5 is a flow diagram showing control processors used by said controller.

The process the collision detector 206 uses in the preferred embodiment to detect a collision is seen in FIG. 5. Using the back EMF zero crossing data successive half period times are stored 504 and a smoothed or filtered value for each of the first and second half periods is calculated 500, 502. These smoothed values which provide an average are summed 506 and the sum is monitored for an abrupt reduction. This is done by comparing the sum with the sum of the two most recently measured half periods. If the difference exceeds an amount A (506) a collision may be implied. Because of a signal noise caused for various reasons, it is not safe to consider one transient reduction exceeding value A as indicative of a piston collision. A number, B, of successive reductions greater than A is required. The variable B (508) is preferably set at five successive cycles. The threshold difference value A is preferably set at 30 microseconds.

When a collision is detected (510, FIG. 5), the current controller (208, FIG. 4) decreases the current magnitude. The reductions to the current and thus input power to the motor are reduced incrementally. Once the collisions stop, the current value is allowed to slowly increase to its previous value over a period of time. Preferably the period of time is approximately 1 hour. Alternatively the current will remain reduced until the system variables change significantly. In one embodiment where the system in WO01/79671 is used as the main current controller algorithm, such a system change might be monitored by a change in the ordered maximum current. In that case it would be in response to a change in frequency or evaporator temperature. In the preferred embodiment the combination of that algorithm with the present invention providing a supervisory role provides an improved volumetric efficiency over the prior art.

The invention claimed is:

1. A sensorless method of detecting piston collisions in a reciprocating free piston linear compressor driven by an electronically commutated linear motor having at least one excitation winding electronically commutated under the control of a programmed microprocessor comprising providing an indication of a piston collision upon detection of any sudden change in the characteristics of the back EMF waveform induced in said at least one excitation winding, wherein piston collisions are determined by the microprocessor software solely from microprocessor input signals from said at least one excitation winding and without input from any external transducer.

2. A sensorless method of detecting piston collisions in a reciprocating free piston linear compressor driven by an electronically commutated linear motor having at least one excitation winding electronically commutated under the control of a programmed microprocessor comprising the steps of:

obtaining the time varying back EMF induced in said at least one excitation winding, monitoring said back EMF at least in the regions near the back EMF zero-crossings, extracting parameters characterising said back EMF waveform;

analysing said parameters;

providing an indication of a piston collision upon detection of any sudden change in said parameters, and wherein piston collisions are determined by the microprocessor software solely from microprocessor input signals from said at least one excitation winding and without input from any external transducer.

* * * * *